United States Patent [19]

Sato

[11] 4,227,456

[45] Oct. 14, 1980

[54] PRINTING PRESSURE BUFFER MECHANISM OR CONSTANT PRESSURE PRINTING MECHANISM FOR HAND-OPERATED LABEL PRINTING MACHINE

[75] Inventor: Yo Sato, Tokyo, Japan

[73] Assignee: Kabushiki Kaisha Sato Kenkyusho, Tokyo, Japan

[21] Appl. No.: 904,758

[22] Filed: May 11, 1978

[30] Foreign Application Priority Data

May 16, 1977 [JP] Japan ..... 52-055287
May 16, 1977 [JP] Japan ..... 52-055288

[51] Int. Cl.[3] ..... B41K 5/00; B41J 9/42

[52] U.S. Cl. ..... 101/291; 101/298; 156/384; 173/120; 74/97; 400/166; 400/388; 400/437; 400/686; 227/132

[58] Field of Search ..... 156/384; 101/287, 288, 101/291, 292, 316, 297, 93.02, 93.03, 298, 10, 20; 400/157.3, 166, 167, 388, 388.1, 389, 397, 424, 428, 435, 437, 440.2, 648, 649, 652, 686, 687; 267/158; 227/132; 74/97.2; 173/118, 120, 139; 251/75, 76, 77, 78, 80, 251, 252, 263

[56] References Cited

U.S. PATENT DOCUMENTS

| | | | |
|---|---|---|---|
| 879,123 | 2/1908 | Smith | 400/397 |
| 1,967,436 | 7/1934 | Going | 400/388.1 |
| 2,455,270 | 11/1948 | Ravella | 173/120 |
| 2,894,613 | 7/1959 | Ayres | 400/437 |
| 3,008,482 | 11/1961 | Hunter | 251/75 |
| 3,362,326 | 1/1968 | Delpo et al. | 101/316 |
| 3,467,355 | 9/1969 | Burke | 251/78 |
| 4,072,105 | 2/1978 | Becker et al. | 101/288 |

OTHER PUBLICATIONS

Mathews, Print Hammer Mechanism, IBM Tech. Discl. Bulletin, vol. 19, No. 9, pp. 3245-3246, 2/1977.

*Primary Examiner*—William Pieprz
*Attorney, Agent, or Firm*—Ostrolenk, Faber, Gerb & Soffen

[57] ABSTRACT

In a hand-operated label printing machine, including a hand lever and a printing head attached to the hand lever; a printing pressure buffer mechanism or a constant pressure printing mechanism which comprises: in a first embodiment, a spring-actuated engaging member formed in the hand lever and a cooperating checking shoulder which is formed in the main body of the machine; an inclined groove leads to the shoulder; the shoulder is brought into disengageable engagement with the spring-actuated engaging member for moderating the printing pressure; and when the spring-actuated engaging member rides over the checking shoulder, the printing head is actuated; in a second embodiment, a pressure receiving engaging member is carried on the hand lever, through a lost motion connection; a pressure contact member and a guide member are both carried on the main body of the machine and are spaced apart; the pressure receiving engaging member is integrally provided with a pressure receiving piece having a cam surface at the tip end thereof and with a guide piece, spaced from the pressure receiving piece and having an engaging portion at the tip end thereof; when the hand lever is actuated, the cam surface of the pressure receiving engaging member rides across the pressure contact member and the printing is performed at a predetermined pressure; at the same time, the engaging portion of the guide piece is brought into resilient engagement with the guide member to moderate the shock in the printing stroke.

19 Claims, 7 Drawing Figures

PRINTING PRESSURE BUFFER MECHANISM OR CONSTANT PRESSURE PRINTING MECHANISM FOR HAND-OPERATED LABEL PRINTING MACHINE

BACKGROUND OF THE INVENTION

1. Field of the Invention

This invention relates to a constant pressure printing mechanism or a printing pressure buffer mechanism for use in a hand-operated label printing machine for regulating the printing pressure that is applied by the types of the printing head, so as to attain clear and precise printing of labels, without different darkness printed characters and without double printing.

2. Description of the Prior Art

Conventional hand-operated label printing machines include a label printing head which is attached to a hand operated printing lever and which is opposed to the platen. The hand or printing lever is pivotally secured to the machine frame. The printing head is driven by turning of the printing lever with respect to the main body of the label printing machine until the type faces disposed in the lower part of the printing head are brought into contact with a label which is carried on a platen, thereby printing the label.

In such a label printing machine, the printing pressure applied by the printing head to the platen and the label thereon is directly influenced by the intensity of the squeezing force applied by the user to the hand or printing lever. When the hand lever is squeezed weakly, the printing pressure is weak, and the imprint on the label is obscure. When the hand lever is squeezed too strongly, the printing pressure is very large. If the type faces of the printing head are made of a rigid material, such as a metal, minute vibration of the printing head occurs in the direction perpendicular to the surface of the platen, and double printing occurs. If the type faces of the printing head are made of an elastic material, such as rubber, the types are flattened during printing under pressure, so that the imprint becomes obscure due to the spreading of the ink.

Further, when the hand lever is squeezed too strongly, the labels and the platen are often damaged by the type faces which are made of rigid material such as a metal and the labels are often stained. Still further, the types and the platen must be replaced with new ones after only relatively short periods of use, which is disadvantageous.

Even when labels are somewhat indistinctly printed with a conventional label printing machine, they are still accepted because customers can read them when they purchase the labeled commodities and cashiers can also read them when they totalize prices. In recent years, the figures, symbols (bar codes, OCR characters, etc.), and the like that are printed on labels have come to be read by computerized optical readers in place of cashiers in order to put what is called a POS (point of sales) system into practice. In this system, information concerning stocks, sales, kinds of goods, etc. are memorized and processed by electronic computers. Therefore, it has become necessary that the labels to be read always be printed with clear and precise characters and symbols.

Accordingly, in order to exert the proper printing pressure on a label and to perform clear printing, the hand lever must be squeezed by a suitable force. It is, however, quite difficult to control or predict the force of squeezing of the hand lever by all operators.

SUMMARY OF THE INVENTION

It is, therefore, the primary object of the present invention to provide a buffer mechanism or constant pressure printing mechanism for moderating and controlling the printing pressure in a label printing machine, especially one of the hand-operated variety.

It is another object of the present invention to provide a constant pressure printing mechanism or a buffer mechanism wherein the printing head imprints a label only when the intensity of the squeeze applied to the hand lever exceeds a certain level of pressure.

It is another object of the present invention to provide a constant pressure printing mechanism which moderates the shock of the printing stroke of the printing head against the platen.

It is a further object of the present invention to provide a constant pressure printing mechanism which is quite effective for clearly and precisely printing labels without causing double printing.

A further object of the present invention is to provide a printing pressure buffer mechanism or a constant pressure printing mechanism which is reliable in operation, but which is simple in structure and durable in use.

The invention comprises an engaging member on one of the hand operated, printing head supporting, hand or printing lever, on the one hand, or on the body or frame of the label printing machine, on the other hand. There is a guide track for the pressure applying element. This track terminates in a restraining element which must be overridden by the engaging member. The guide track and the restraining element are on the other of the hand or printing lever, on the one hand, or the body of the label printing machine, on the other hand. Appropriate resilient of biasing means oppose the overriding by the engaging member of the restraining element until a predetermined printing pressure on the hand or printing lever is exceeded.

The first embodiment of the present invention comprises a printing pressure buffer mechanism including at least one spring-actuated engaging member, which is formed on either the main body of the label printing machine or on the hand or printing lever, and includes at least one cooperating restraining element, in the form of a checking shoulder, which is formed on the other of the main body and the hand lever and which is brought into disengageable engagement with the spring-actuated engaging member. When the spring-actuated engaging member is moved into engagement with the checking shoulder, the printing pressure is moderated. When the spring-actuated engaging member rides over the checking shoulder after a predetermined pressure is applied to the hand lever, the printing head is moved to imprint a label then on the platen.

Furthermore, the printing pressure buffer mechanism of the present invention is preferably comprised of a pair of the spring-actuated engaging members and a corresponding pair of the checking shoulders.

Each spring-actuated engaging member is comprised of a spring holding recess, a helical compression spring that is received within the recess and a rotatable ball which is brought into engagement with the checking shoulder under the force of the compression spring.

A ball guiding groove is preferably provided in opposition to the ball and it is shaped and placed to guide the movement of the rotatable ball as the hand lever is moved. The checking shoulder is formed at the end of the guiding groove which the ball passes when the hand lever is squeezed.

When the hand lever is squeezed too weakly, the printing head does not imprint any labels, since the spring-actuated engaging member is stopped by the checking shoulder. If the hand lever is squeezed too strongly, the excessive force applied to the printing head is moderated by the buffer mechanism, since the spring-actuated engaging member is checked by the checking shoulder before the printing head is brought into operation. Therefore, the printing of labels can always occur under a constant predetermined pressure. As a result, the imprints on the labels can always be made distinct.

In accordance with the second embodiment of the present invention, the buffer mechanism or constant pressure printing mechanism has the following features. The engaging member is a pressure receiving member. Biasing means urge the engaging member to contact a restraining element. The engaging member is integrally provided with a pressure receiving piece having a cam surface at the tip end thereof. It is also integrally provided with a guide piece having an engaging portion at the tip end thereof. When the hand lever is actuated, the cam surface of the pressure receiving piece rides across the restraining element on the labeling machine frame under the spring controlled resilient force, which regulates the intensity of the printing stroke and the printing is then carried out. During this printing stroke, the engaging portion of the guide piece on the engaging member is brought into resilient engagement with a guide member on the labeling machine frame to moderate the shock of the printing stroke.

The pressure receiving member has a slot at the lower part thereof and is pivotally secured to the hand lever by a guide pin through the slot. This guide pin is fixed to the hand lever. The pressure contact member is comprised of a supporting pin and a pressure guide roller which is rotatably fitted to the pin, and the guide member is also comprised of a supporting pin and a guide roller which is rotatably fitted to the latter supporting pin.

Although the engaging member has been described as being on the hand lever while the element has been recited as being on the labeling machine frame, the pressure receiving engaging member may be attached to either the main body of the machine or to the hand lever, and the restraining element and the guide member would be attached to the other one of the main body and the hand lever.

BRIEF DESCRIPTION OF THE DRAWINGS

The foregoing and other objects and features of the present invention will become more apparent from the following description taken in connection with the accompanying drawings, in which.

DESCRIPTION OF THE PREFERRED EMBODIMENTS

Figure 1:
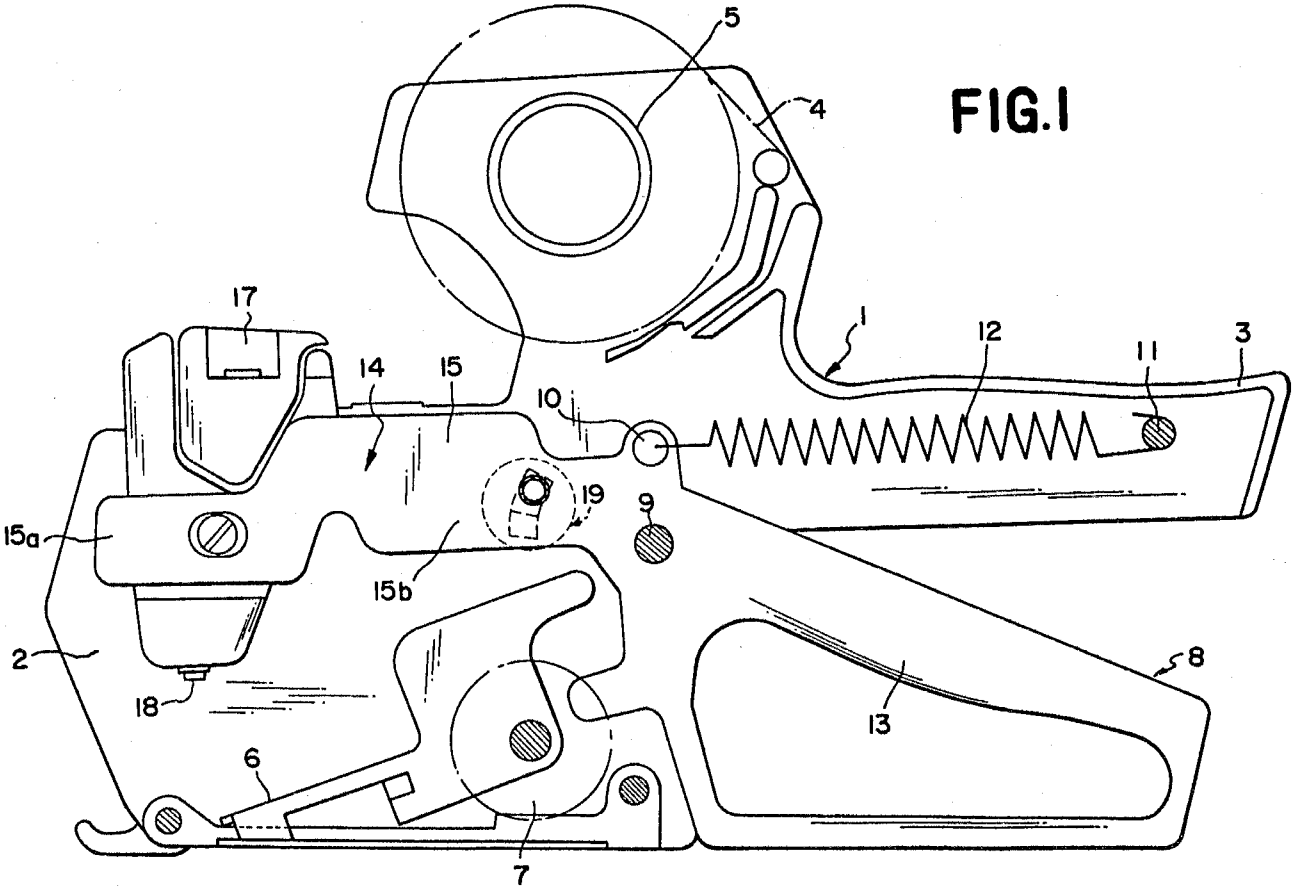
FIG. 1 is a side elevational view of a label printing machine in the released position, which is provided with an embodiment of the printing pressure buffer mechanism of the present invention, the side plate on the viewing side being removed.

A first embodiment of the invention is shown in FIGS. 1 to 4.

The label printing machine has a main body 1 comprised of a pair of parallel side plates 2, which are spaced apart a predetermined distance. A hand grip 3 is integrally formed on the rear or right hand side of the respective side plates 2. A label holder 5 is integrally formed on the rear part of one side of the side plates 2. The holder 5 carries a rolled tape-like label strip 4. A stationary platen 6 is supported between the lower parts of the side plates 2. A feed roller 7 advances the label strip 4 from the label holder 5 to the platen 6 through a guiding groove (not shown) in a manner known in the art.

A hand lever 8 is disposed in the space between the side plates 2. The middle portion of the lever 8 is pivotally supported on a turning shaft 9 which is supported in the side plates 2. At the upper edge at the middle portion of the hand lever 8 above the pivot shaft 9, there is a spring hook hole 10. A spring pin 11 is formed on the hand grip 3. Between the spring hook hole 10 and the spring pin 11, a return spring 12 is stretched. The hand lever 8 is urged clockwise in FIG. 1 by the return spring 12 about the fulcrum of the turning shaft 9.

The rear (right) half of the hand lever 8 beyond the turning shaft 9 is provided with a grip portion 13 which is squeezed together with and toward the hand grip 3.

The front half 14 of the hand lever 8 is a printing lever which supports a printing head. The printing lever 14 is comprised of a pair of parallel, spaced apart side walls 15 and of a connecting wall 16, which connects the rear (right hand) end portions **15*b* of the side walls 15. A printing head 17 is attached to the front (left hand) end portions 15*a* of the side walls 15. At its bottom portion, the printing head 17 carries type faces 18, which print the label of the label strip 4 which is then on the platen 6**.

A pair of printing pressure buffer mechanisms 19 are attached in the space between both side plates 2 of the main body 1 and the opposed side walls 15 of the printing lever 14. Since the structures of both printing pressure buffer mechanisms 19 are the same, the buffer mechanism 19 on only one side is described.

The printing pressure buffer mechanism 19 is formed in the side plate 2 of the main body 1 of the label printing machine. The buffer mechanism 19 is arcuately shaped, as viewed from the side, on a part of the circle around the axis of the turning shaft 9. Each buffer mechanism 19 is comprised of a guiding groove 27, a spring holding recess 30 and a spring-actuated engaging member 31.

The guiding groove 27 has an open side 20, which opens on the inside wall 21 of the side plate 2. The inner bottom surface 22 of the guiding groove 27 gradually inclines deeper into the plate 2 from the top end 23 of the groove 27, around its arcuate curve (FIG. 1) to the bottom end 24, whereby bottom surface 22 of groove 27 forms an inclined plane. At its bottom end 24 of groove 27 has a restraining element comprised of checking shoulder 26, which extends toward the inside wall 21 for temporarily stopping the below-mentioned rotatable ball 25 of the engaging member, while still allowing the ball 25 to ride over the shoulder 26.

The spring holding recess 30 extends along the length of the connecting wall 16 (horizontally in FIG. 3) in the printing lever 14. The recess 30 opens at opening 28 on the outer surface 29 of the side wall 15.

The spring-actuated engaging member 31 is comprised of a helical compression spring 32, which is received within the spring holding recess 30, and of a rotatable ball 25 which is made of metal, a synthetic resin, or the like. The ball 25 is supported between one end 32*a* of the helical compression spring 32 and the bottom surface 22 of the guiding groove 27, and the ball is moved along the guiding groove 27 and through the opening 28 of the spring holding recess 30. By the force of the spring 32, the ball 25 is always urged toward the bottom surface of the guiding groove 27.

The operation of the above-described first embodiment of the printing pressure buffer mechanism 19 of the hand-operated label printing machine is now described.

First to be described is the case in which the hand lever 8 is squeezed with a relatively weak force.

In the rest position of FIG. 1, the return spring 12 urges the hand lever 8 clockwise, and the printing head 17 is separated from the platen 6. The rotatable ball 25 of the spring-actuated engaging member 51 is positioned at the upper end 23 of the guiding groove 27. At the same time, the ball is pressed toward the inner bottom surface 22 of the guiding groove 27 by the force of the helical compression spring 32.

Figure 2:
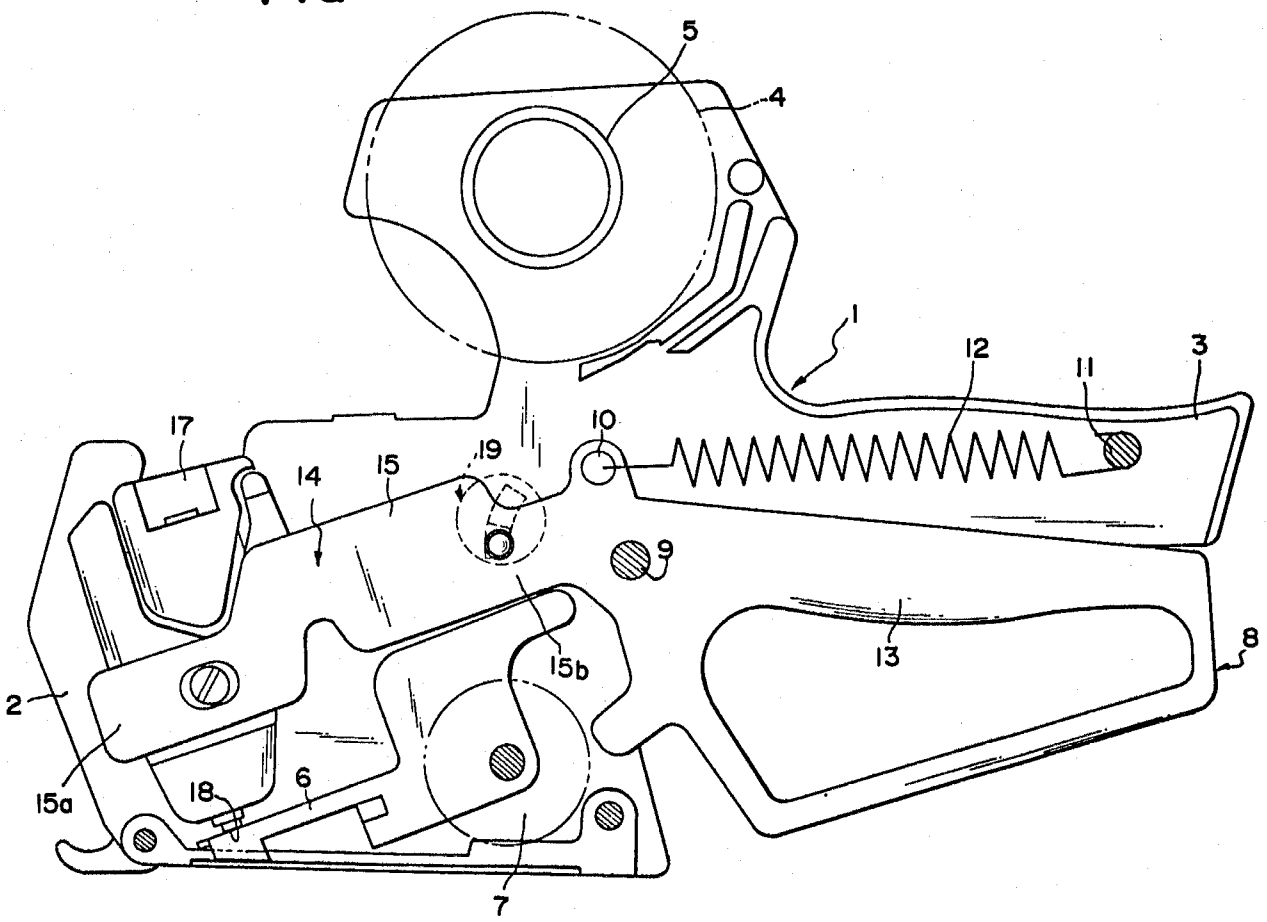
FIG. 2 is the same view in which the hand lever is turned to the printing position.
Figure 3:
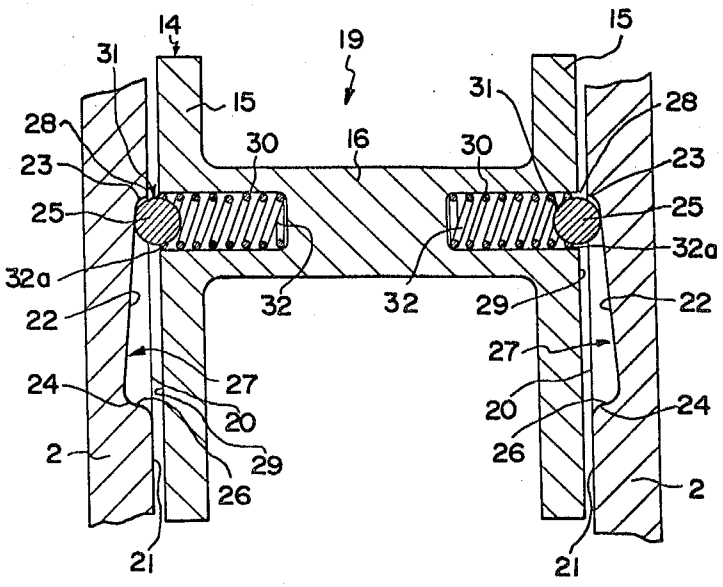
FIG. 3 is a vertical cross-sectional view of the main part of the printing pressure buffer mechanism of the first embodiment of the present invention.
Figure 4:
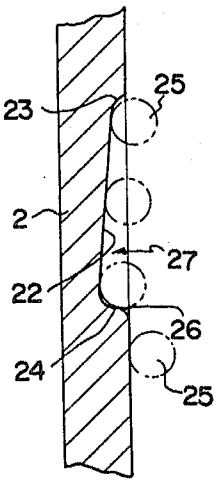
FIG. 4 is a vertical cross-sectional view of a part of the printing pressure buffer mechanism showing the movement of the rotatable ball of the buffer mechanism.

When the hand grip 3 and the hand lever 8 are squeezed together, the hand lever 8 is turned counterclockwise about the turning shaft 9, from the state of FIG. 1 to the state of FIG. 2, against the force of the return spring 12. Simultaneously, the printing lever 14 and the printing head 17 are also turned counterclockwise.

This moves the ball 25 from the top end 23 toward the bottom end 24 of the guiding groove 27. During such movement, the ball 25 is pressed to the inner bottom surface 22 of the guiding groove 27 and is gradually let out from the opening 28 of the spring holding recess 30. The motion of the rotatable ball 25 is stopped when the ball 25 abuts the checking shoulder 26 at the bottom end of the guiding groove 27. As motion of the rotatable ball 25 is stopped, the counterclockwise turning movement of the hand lever 8 around the turning shaft 9 is also stopped.

When the force for turning the hand lever 8 counterclockwise is smaller than the force which is necessary to press the rotatable ball 25 into the spring holding recess 30 against the force of the helical compression spring 32, the ball 25 is stopped by the checking shoulder 26 and it cannot ride over the shoulder 26 so that the hand lever 8 cannot be turned counterclockwise any further. Accordingly, the printing head 17 does not reach the label strip 4 carried on the platen 6 and no printing is done.

Upon release of the hand lever 8, the hand lever 8, the printing lever 14 and the printing head 17 are all turned clockwise as viewed in FIG. 1 about the turning shaft 9. This motion returns the ball 25 to the top end 23 of the guiding groove 27. At the same time, the ball 25 is pressed into the spring holding recess 30 through the opening 28 against the force of the helical compression spring 32. This is enabled to occur because the spring 12 is stronger than the springs 32. All of the foregoing elements return to their rest positions shown in FIGS. 1 and 3.

When the hand lever 8 is squeezed with a relatively larger force, printing is accomplished under a proper, predictable printing pressure. Again, the motion of the rotatable ball 25 of the spring-actuated engaging member 31 is stopped by the checking shoulder 26 of the guiding groove 27.

From this state, when the hand lever 8 is further turned counterclockwise about the turning shaft 9, the printing lever 14 is also turned further counterclockwise about the turning shaft 9. This causes the rotatable ball 25 to ride over the checking shoulder 26. At the same time, the ball 25 moves into the spring holding recess 30 through the opening 28 against the force of the helical compression spring 32. Once it passes the shoulder 26, the ball 25 moves along the inside wall 21 of the side plate 2 for a little distance until the type faces 18 of the printing head 17 are brought into contact with the label strip 4 carried on the platen 6, thereby printing a label then on the platen.

When the fully squeezed hand lever 8 is releaed, the hand lever 8 is returned clockwise about the turning shaft 9 by the force of the return spring 12 from the state of FIG. 2. The rotatable ball 25 is shifted upward in FIG. 3 along the inside wall 21 of the side plate 2, and under the force of the helical compression spring 32, the ball drops back into the guiding groove 27 after passing the checking shoulder 26. The operation after this are the same as those of the first mentioned case.

If the hand lever 8 is squeezed with a quite large force, the label printing machine operates in almost the same manner as in the foregoing second case. However, the excessive squeezing force applied to the hand lever 8 is somewhat moderated by the helical compression spring 32 when the ball 25 of the spring-actuated engaging member 31 collides with the checking shoulder 26 of the guiding groove 27 and then rides over the shoulder 26 against the moderating force of the compression spring 32. If one helical compression spring 32 in the spring holding recess 30 is replaced with another spring 32 having a different elastic force, printing under a proper printing pressure can always be attained and quite clear printing can be accomplished even when, for example, the thickness or the hardness of the label strip 4 is varied.

Further, the rotatable ball 25 can be moved into and out of the spring holding recess 30 against the force of the helical compression spring 32, so that the printing pressure can be smoothly moderated. At the same time, the squeezing of the hand lever 8 and the action of the printing head 17 are also carried out smoothly.

Still further, since the rotatable ball 25 and the helical compression spring 32 of the spring-actuated engaging member 31 are separate elements, each of them can be independently replaced when, for example, the ball 25 becomes worn or the elastic force of the compression spring 32 becomes weakened. In contrast to the case in which the whole of the spring-actuated engaging member 31 is integrally formed with the printing lever 14, the printing pressure buffer mechanism of the present invention can be serviceable for a long period of time.

Although the spring-actuated engaging member 31 is described as being formed in the printing lever 14 of the lever 8 and the checking shoulder 26 as being formed in the side plate 2, the buffer mechanism is not restricted to this arrangement. The spring-actuated engaging member 31 may be formed in the side plate 2, or both the spring-actuated engaging member 31 and the checking shoulder 26 may be formed between the printing lever 14 and the platen 6, or between the grip portion of the hand lever 8 and the hand grip 3. Furthermore, the helical compression spring 32 and the rotatable ball 25 of the spring-actuated engaging member 31 are described as separately formed. However, even without using the helical compression spring 32, the spring-actuated engaging member 31 may be formed in a spherical shape and be integral with the side wall 15 of the printing lever 14 by using an elastic material. Still further, if the side plate 2 has no guiding groove 27, only a simple checking shoulder 26 need be formed on the side plate 2. In this case, the structure becomes simpler and its production cost can be reduced.

Several further variations or modifications are possible within the scope of the first embodiment of the invention. As described above, in the printing pressure buffer mechanism for a hand-operated label printing machine of the present invention, the spring-actuated engaging member formed on either the main body of the machine or on the hand lever is brought into engagement with the checking shoulder that is formed on the other part, by the operation of the hand lever. Through this operation, the printing pressure is successfully moderated and the printing head is ultimately actuated when the above spring-actuated engaging member rides over the checking shoulder.

The second embodiment of the present invention is now described.

Figure 5:
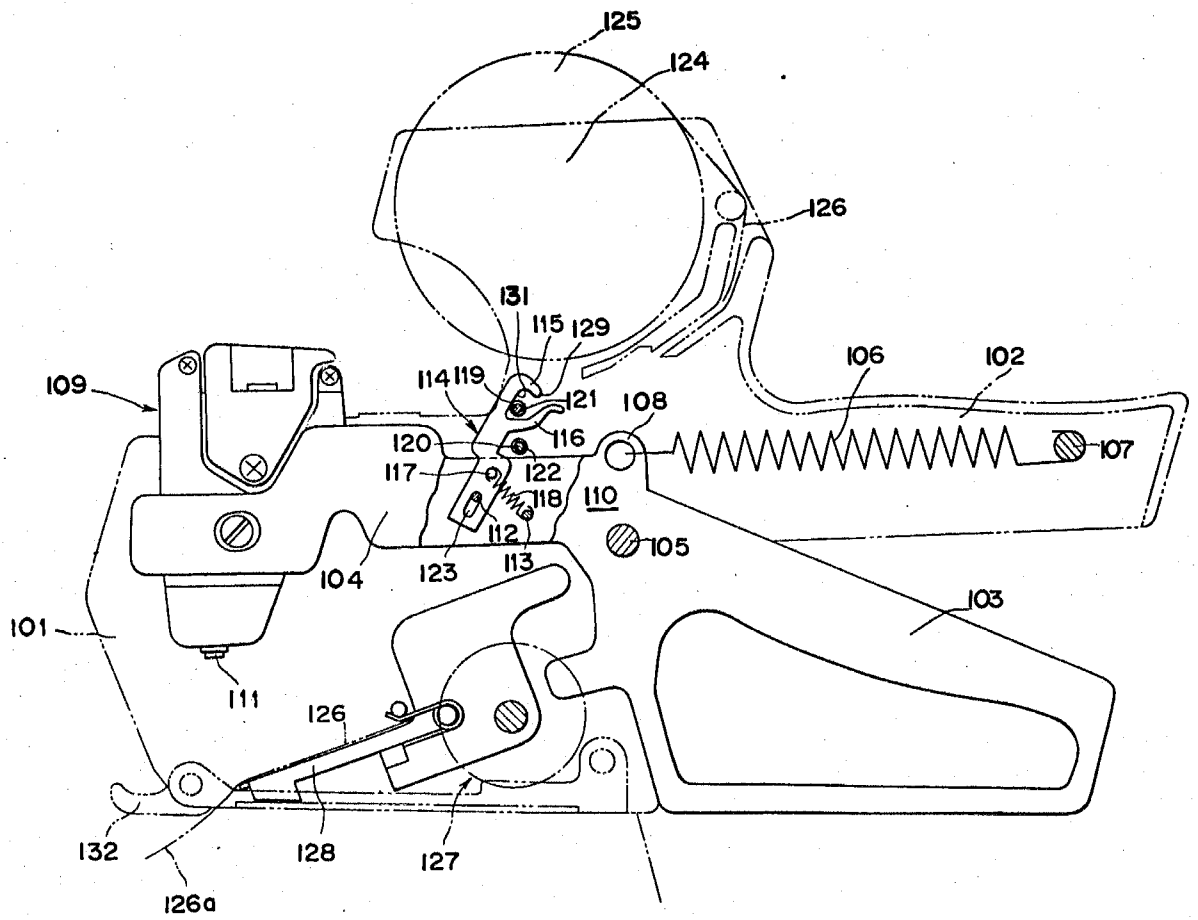
FIG. 5 is a partially cross-sectional, side elevational view of a label printing machine in the rest position, wherein the machine frame on the viewing side is removed, and showing a second embodiment of constant pressure printing or buffer mechanism according to the invention.

Referring to FIG. 5, the illustrated label printing machine has machine frames 101 on both sides and extending parallel to each other. At the rear parts (at the right end in FIG. 5) of both machine frames 101, the hand grip 102 is integrally formed. The pivot shaft 105 is disposed between the machine frames 101. A working lever 110 is pivotally secured on the pivot shaft 105. Lever 110 is comprised of a hand lever 103 at one side of shaft 105 and of a bifurcated printing lever 104 that is formed integrally with the hand lever 103 at the other side of the shaft 105. A return spring 106 is stretched between a spring pin 107, which is formed inside of the hand grip 102, and a spring supporting projection 108, which is formed above the rear part of the printing lever 4 and is spaced above and away from the shaft 105. Both the hand lever 103 and the printing lever 104 are always urged clockwise (in FIG. 5) by the above return spring 106.

A printing head 109 is attached to the front (left in FIG. 5) end of the printing lever 104. Types 11 are disposed in the lower part of the printing head 109.

Extending across the printing lever 104, at its rear part, there are attached and fixedly located a guide pin 112 and a spring pin 113. The guide pin 112 is inserted into a slot 123 that is formed in the lower part of a pressure receiving member 114.

The engaging means comprises the pressure receiving member 114 which is movably supported on the pin 112 that passes through slot 123. The pin is shaped so that its head is large enough to prevent member 114 from falling off pin 112. Other ways of holding member 114 on pin 112 will be apparent. At its upper end, the pressure receiving member 114 is integrally provided with a pressure receiving piece 115 which extends rearward from the upper part of the member 114. Below the piece 115, there is a rearwardly projecting, generally L-shaped, guide piece 116. To the side of the lower part of the pressure receiving member 114 is attached a spring pin 117. Spring 118 is stretched between the spring pin 117 on member 114 and the spring pin 113 on the printing lever. Accordingly, the pressure receiving member 114 is always urged to pivot clockwise (in FIG. 5) about the guide pin 112 by the spring 118.

In the space above the printing levers 104 and extending between the machine frames 101, there is an upper pin 119. A pressure contact roller 121 is rotatably fitted on the pin 119. Pin 119, of roller 121 is the restraining element for restraining the engaging member 114 from moving to permit the printing head to print a label until a predetermined printing pressure has been applied to the hand lever 103. Directly below the pin 119, there is a lower pin 120. A guide roller 122 is likewise rotatably fitted on the lower pin 120. Pin 120, of roller 122 is a guide member for moderating printing pressure by engaging guide piece 116 during the printing stroke of the printing lever 104. As shown in FIG. 5, in the rest position of the label printing machine, the pressure contact roller 121 is in contact with the rearward side 131 of the pressure receiving member 114 in the space between the pressure receiving piece 115 and the guide piece 116.

A label holder 124 above the frames 101 supports a rolled label strip 125. A tape-like label strip 126 is paid out from the rolled label strip 125 and is passed to the upper side of the platen 128 by the conventional feeding mechanism 127, which is disposed in the lower part of the machine body.

The operation of the second embodiment of the constant pressure printing or buffer mechanism of the present invention is now described From the rest position of the label printing machine shown in FIG. 5, when the hand grip 102 and the hand lever 103 are squeezed together, this turns the hand lever 103 upward (or counterclockwise in FIG. 5). The printing lever 104 of the hand lever 103 is turned downward about the pivot shaft 105, so that the printing head 109 is moved downward. In this operation, the inking roller (not shown) rolls on the type faces 111 that are disposed in the bottom portion of the printing head 109 for inking them.

Further, when the printing lever is moved down, the guide pin 112 slides in a lost motion connection down through the slot 123 of the pressure receiving member 114, until the guide pin 112 comes into contact with the lower end of the slot 123. Thereafter the guide pin 112 pushes down the whole engaging means or pressure receiving member 114, so that the lower side of the upper pressure receiving piece 115 and of the lower guide piece 116 of the pressure receiving member 114 are respectively brought into contact with the top sides of the pressure contact roller 121 and the guide roller 122.

Figure 6:
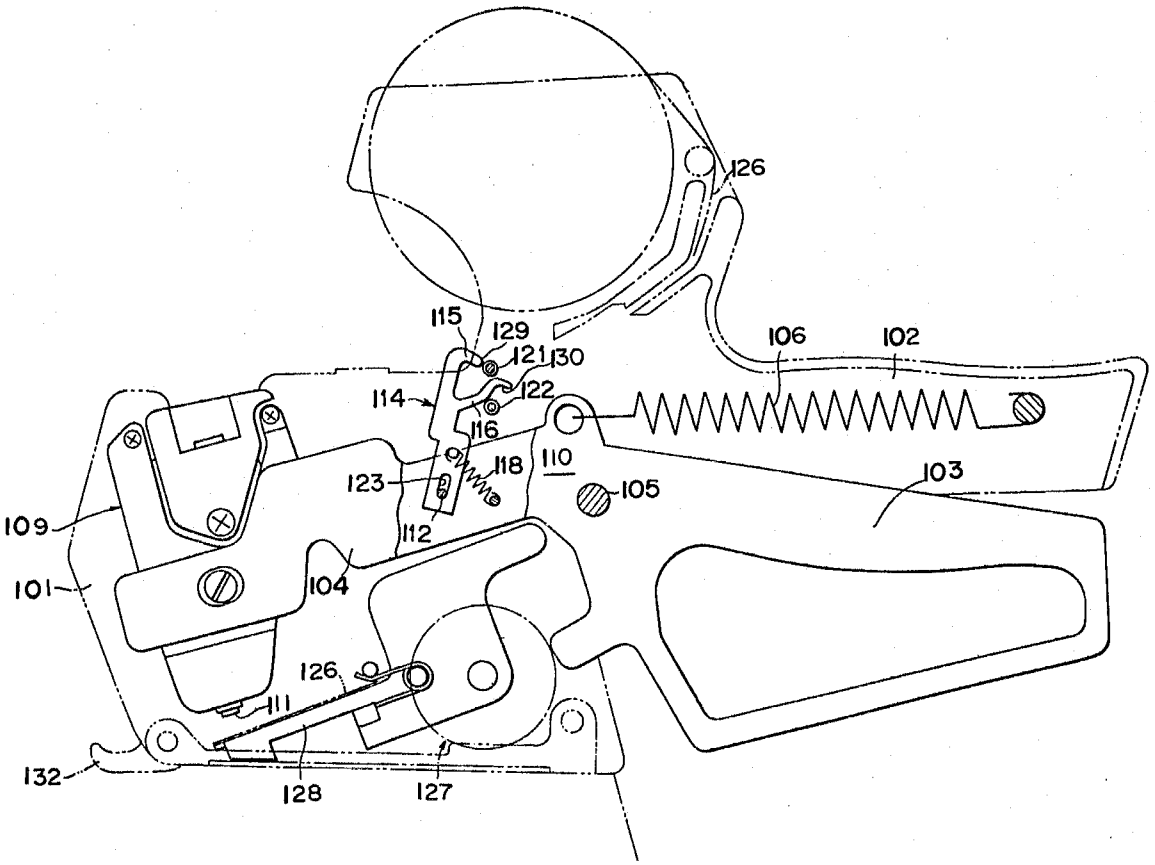
FIG. 6 is the same type of view as FIG. 5, wherein the hand lever is squeezed halfway from the rest position.
Figure 7:
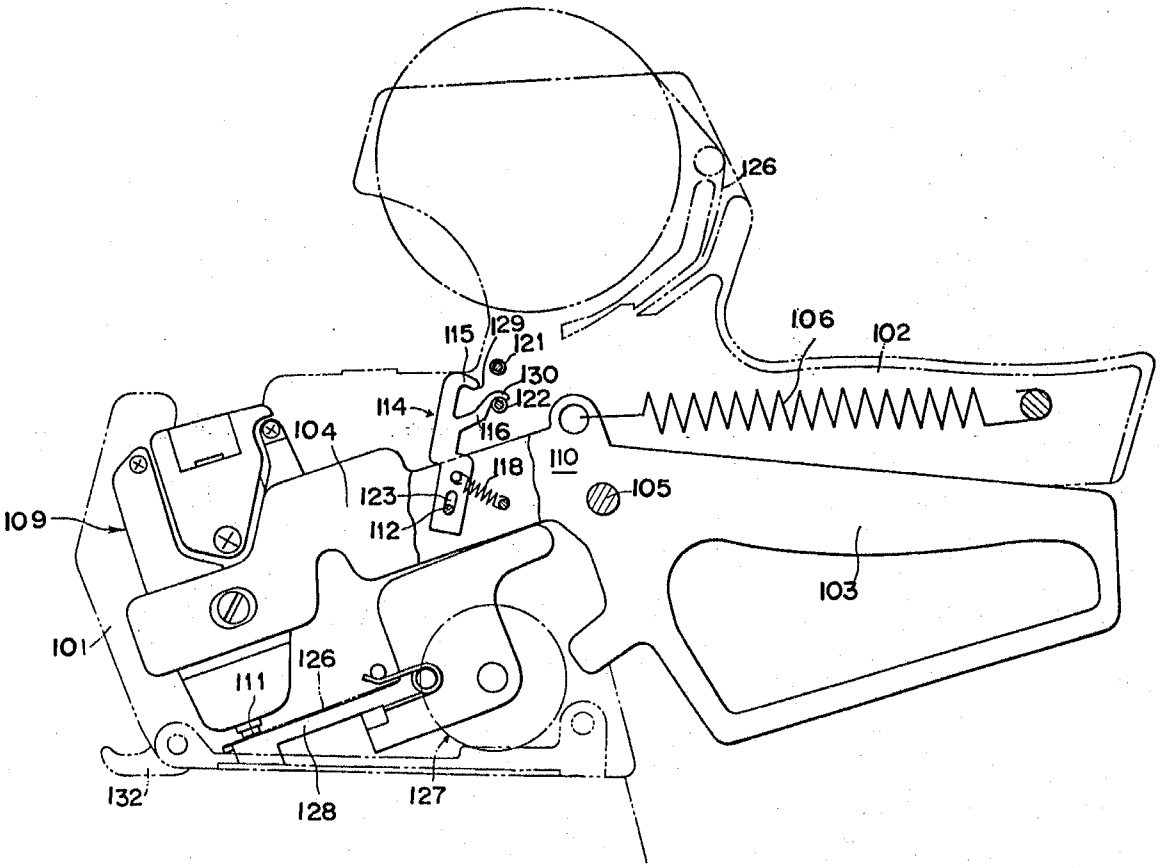
FIG. 7 is the same type of view, wherein the hand lever is fully squeezed.

When the hand lever 103 is further squeezed, the guide roller 122 rolls rearwardly along the undersurface of the guide piece 116, as shown in FIG. 6, and this turns the pressure receiving member 114 counterclockwise, about the guide pin 112 as its fulcrum, against the force of the spring 118. Finally, the pressure contact roller 121 contacts the underside of the cam surface 129 at the tip end of the upper pressure receiving piece 115. As a result, the squeezing force on the hand lever 103 meets with resistance. When the hand lever 103 is further squeezed to overcome this resistance, the cam surface 129 of the pressure receiving piece 115 rides across the pressure contact roller 121 against the force of the spring 118. At the same time, the type faces 111 of the printing head 109 are brought into contact with a tape-like label strip 126 on the platen 128, thereby printing a label, as shown in FIG. 7. Simultaneously with the cam surface 129 riding across the pressure contact roller 121 and freeing the roller 121 from the cam surface 129, the pressure receiving member 114 is turned clockwise down by the tension of the spring 118 until the curved engaging portion 130 at the tip end of the guide piece 116 is stopped by the guide roller 122.

Through the pressure receiving plate 115 riding across the pressure contact roller 121, the printing pressure can be controlled to a certain level. Since the pressure receiving piece 115 rides across the pressure contact roller 121 only when the squeezing force on the hand lever 3 exceeds a cetain level, when the squeezing force on the hand lever 3 is too weak, the operator will feel the resistance and he will strengthen the squeezing force. On the other hand, if the squeezing force is too strong, the squeezing force is moderated properly by the roller 121 riding across the surface 129. Therefore, the type faces 111 of the printing head 109 are brought into contact with the label on the platen 128 under a certain printing pressure.

Furthermore, as printing is occurring, since the engaging portion 130 formed at the tip end of the guide piece 116 of the pressure receiving member 114 is in engagement with the guide roller 122, as shown in FIG. 7, the shock of the printing types striking the label and the platen can be absorbed and buffered by the resilience of the guide piece 116 and by the elastic force of the spring 118.

When the hand lever 103 is thereafter released, the hand lever 103 and the printing lever 104 are turned clockwise about the fulcrum of the pivot shaft 105 by the tensile force of the return spring 106. This moves up the printing head 109. At the same time, the guide pin 112 slides, with a lost motion connection, up through the slot 123 of the pressure receiving member 114 until the pin 112 engages the upper end of the slot 123. After that, the whole pressure receiving member 114 is raised. The undersurface of the guide piece 116 is guided and lifted as it moves by the guide roller 122, and the cam surface 129 of the pressure receiving piece 115 is brought across the pressure contact roller 121, whereby the mechanism returns to its state of FIG. 5. Synchronized with this returning operation, the tape-like label strip 126 is advanced by the length of one label by the feeding mechanism 127, while the printed label **126*a* is transferred below the applicator member 132**.

The present invention is not restricted to the above described embodiment with regard to the positions and constructions of the pressure receiving member 114, the pressure contact roller 121 and the guide roller 122.

Furthermore, the constant printing pressure and buffer mechanisms of the present invention are applicable not only to portable label printing machines, but also to other printing machines, such as price tag attaching machines and desk-type label printing machines.

Accordingly, the following advantages can be expected during use of the label printing machine.

(1) When the squeezing force that is applied to the hand lever and thus to the printing lever is weak, the spring-actuated engaging member is stopped by the restraining element and the former does not ride over the latter, so that the printing head is not brought into operation. Printing cannot occur at a weak printing pressure of the printing head and obscurely printed labels are not produced.

(2) On the other hand, when the squeezing force on the hand lever and thus on the printing lever is excessively large, the spring-actuated engaging member is still checked by the restraining element. Therefore, the large squeezing force can be somewhat moderated. Further, since the printing head is brought into operation only when the spring-actuated engaging member rides over the restraining element, clear printing can always be attained under a constant pressure without fail, and there need be no fear of the occurrence of double printing under a quite large printing pressure.

(3) Since the printing pressure is moderated, the labels and the platen are not damaged by their collisions with the type faces, even when the type faces of the printing head are made of hard material, such as a metal.

(4) Since the engaging member has elasticity, there is only a small shock when the engaging member engages the restraining element. Therefore, the label printing machine does not give an uneasy feeling to users. In addition, since the overriding of the restraining element is smooth, manual operation of the hand lever is also done quite smoothly.

(5) Furthermore, the entire structure of the buffer mechanism is simple so that it can be mass produced.

Although the present invention has been described in connection with a plurality of preferred embodiments thereof, many variations and modifications will now become apparent to those skilled in the art. It is preferred, therefore, that the present invention be limited not by the specific disclosure herein, but only by the appended claims.

What is claimed is:

1. A label printing machine, comprising:

a machine frame; a printing platen supported on said machine frame;

a printing lever movably supported to said frame; a printing head on said printing lever and movable with said printing lever; said printing head having types opposable to said platen; said printing lever, with said printing head, being movable from a released position, with said printing head away from said platen, to a printing position with said printing head in engagement with said platen;

engaging means on one of said printing lever and said frame; said engaging means comprising a recess located in the one of said printing lever and said frame that carries said engaging means; said engaging means also comprising a rotatable ball which is movable into and out of said recess along a pathway across the direction of motion of said printing head toward said platen; biasing means normally biasing said rotatable ball out of said recess;

a shoulder projecting out from the surface of the other of said printing lever and said frame and projecting toward the one of said printing lever and said frame on which said engaging means is positioned; said shoulder being placed such that upon said printing head moving toward said printing position, and before said printing head reaches said printing position, said rotatable ball, then biased out of said recess by said biasing means, abuts said shoulder, and said biasing means inhibits said rotatable ball from shifting to permit said ball to bypass said shoulder; said rotatable ball being moved into said recess to permit said rotatable ball to move past said shoulder, whereby shifting of said rotatable ball in said recess is under the influence of both of said shoulder and said biasing means; said rotatable ball being rotatable as said rotatable ball engages the other of said printing lever and said frame from which said shoulder projects as said printing lever and said frame move past one another;

upon sufficient force being applied to move said printing lever to said printing position, said rotatable ball and said shoulder passing one another, and said printing lever and said printing head thereafter being free to move said printing head to said printing position.

2. The label printing machine of claim 1, further comprising a guiding groove in the one of said printing lever and said frame from which said shoulder projects; said groove extending along the pathway on which said rotatable ball travels as said printing head moves to said printing position; said rotatable ball being biased by said biasing means into said groove; said groove having ends along the pathway of said rotatable ball along said groove and said shoulder being at the said end of said groove toward which said rotatable ball moves as said printing head moves to said platen.

3. The label printing machine of claim 2, wherein said groove is depressed to incline deeper into the one of said printing lever and said frame carrying said shoulder and said groove depression inclining deeper toward said shoulder.

4. The label printing machine of claim 1, wherein said recess is directed perpendicular to the one of said printing lever and said frame carrying said restraining element.

5. The label printing machine of any of claims 1, 4, 2 or 3, wherein said printing lever is pivotally attached on said frame to pivot between the positions thereof.

6. The label printing machine of any of claims 1, 4, 2 or 3, wherein said shoulder is on said frame and said engaging means is on said printing lever.

7. The label printing machine of claim 6, wherein said printing lever is pivotally attached on said frame to pivot between the positions thereof.

8. A label printing machine, comprising: a machine frame; a printing platen supported on said machine frame;

a printing lever movably supported to said frame; a printing head on said printing lever and movable with said printing lever; said printing head having types opposable to said platen; said printing lever, with said printing head, being movable from a released position, with said printing head away from said platen, to a printing position, with said printing head in engagement with said platen;

engaging means on one of said printing lever and said frame;

a restraining element on the other of said printing lever and said frame; said restraining element being placed such that upon said printing head moving toward said printing position, and before said printing head reaches said printing position, said engaging means abuts said restraining element; said engaging means being operable to shift its position to permit itself to move past said restraining element;

biasing means connected with said engaging means for biasing said engaging means to prevent said engaging means from shifting to permit said engaging means to bypass said restraining element; upon sufficient force being applied to gradually move said printing lever to said printing position, said engaging means and said restraining element passing one another, and said printing lever and said printing head thereafter being free to move said printing head to said printing position;

said engaging means including a pressure receiving piece having a cam surface thereon; said cam surface of said pressure receiving piece riding across said restraining element as said biasing means urge said cam surface against said restraining element until said cam surface fully passes by said restraining element, which frees said printing lever to move with said printing head to said printing head printing position;

said engaging means further including a guide piece thereon; the one of said frame and said printing lever holding said restraining element further holding a guide member thereon and said guide member being placed and said guide piece being so positioned that said guide piece engages said guide member when said pressure receiving piece has separated from said restraining element, for moderating the shock of the printing stroke of said printing head to said platen.

9. The label printing machine of claim 8, wherein said restraining element is on said frame and said engaging means is on said printing lever.

10. The label printing machine of claim 9, wherein said engaging means comprises an arm, which is pivotally attached to said printing lever; said biasing means biases said engaging means arm to pivot so that said arm and said pressure receiving piece are always in engagement with said restraining element, until said cam surface passes by said restraining element; said biasing means further biasing said engaging means arm to pivot so that said guide piece engages said guide member.

11. The label printing machine of claim 10, wherein both said pressure receiving piece and said guide piece project from said engaging means arm in the same direction and are spaced from each other along said engaging means arm.

12. The label printing machine of claim 11, wherein said engaging means arm has a slot defined therein which is elongated in the direction of motion of said printing lever with respect to said frame; said printing lever having a pin thereon which is received in said engaging means slot, and serves as the pivot mount for said engaging means arm, there is lost motion before said engaging means is engaged by said pin contacting an end of said slot and moving said engaging means arm.

13. The label printing machine of any of claims 8 or 12, wherein said printing lever is pivotally attached to said frame to pivot between the positions thereof.

14. The label printing machine of claim 12, wherein said restraining element comprises a supporting pin and a pressure guide roller which is rotatably fitted to said supporting pin and said pressure guide roller engages said pressure receiving piece cam surface;

said guide member comprising a supporting pin and a guide roller rotatably fitted to said guide member supporting pin.

15. A label printing machine, comprising:

a machine frame; a printing platen supported on said machine frame;

a printing lever movably supported to said frame; a printing head on said printing lever and movable with said printing lever; said printing head having types opposable to said platen; said printing lever, with said printing head, being movable from a released position, with said printing head away from said platen; to a printing position, with said printing head in engagement with said platen;

engaging means on one of said printing lever and said frame;

a restraining element on the other of said printing lever and said frame; said restraining element being placed such that upon said printing head moving toward said printing position, and before said printing head reaches said printing position, said engaging means abuts said restraining element; said engaging means being operable to shift its position to permit itself to move past said restraining element;

biasing means connected with said engaging means for biasing said engaging means to prevent said engaging means from shifting to permit said engaging means to bypass said restraining element; upon sufficient force being applied to gradually move said printing lever to said printing position, said engaging means and said restraining element passing one another, and said printing lever and said printing head thereafter being free to move said printing head to said printing position;

said engaging means including a pressure receiving piece having a cam surface thereon; said cam surface of said pressure receiving piece riding across said restraining element as said biasing means urge said cam surface against said restraining element until said cam surface fully passes by said restraining element, which frees said printing lever to move with said printing head to said printing head printing position;

said engaging means having a slot defined therein which is elongated in the direction of motion of said printing lever with respect to said frame; the one of said printing lever and said frame carrying said engaging means further having a pin thereon which is received in said engaging means slot, whereby as said printing lever shifts with respect to said frame, there is lost motion before said engaging means is engaged by said pin contacting an end of said slot and moving said engaging means.

16. The label printing machine of claim 15, wherein said engaging means further includes a guide piece thereon; the one of said frame and said printing lever holding said restraining element further holding a guide member thereon and said guide member being placed and said guide piece being so positioned that said guide piece engages said guide member when said pressure receiving piece has separated from said restraining element, for moderating the shock of the printing stroke of said printing head to said platen.

17. The label printing machine of claim 15, wherein said restraining element is on said frame and said engaging means is on said printing lever.

18. The label printing machine of claim 15, wherein said printing lever is pivotally attached on said frame to pivot between the positions thereof.

19. The label printing machine of claim 15, wherein said restraining element comprises a supporting pin and a pressure guide roller which is rotatably fitted to said supporting pin and said pressure guide roller engages said pressure receiving piece cam surface;

said guide member comprising a supporting pin and a guide roller rotatably fitted to said guide member supporting pin.

* * * * *